US010036235B2

(12) United States Patent
Stam et al.

(10) Patent No.: US 10,036,235 B2
(45) Date of Patent: Jul. 31, 2018

(54) ASSEMBLY AND METHOD FOR EXPANDING A TUBULAR ELEMENT

(71) Applicant: SHELL OIL COMPANY, Houston, TX (US)

(72) Inventors: Walter Stam, Rijswijk (NL); Antonius Leonardus Maria Wubben, Rijswijk (NL); Djurre Hans Zijsling, Rijswijk (NL)

(73) Assignee: SHELL OIL COMPANY, Houston, TX (US)

( * ) Notice: Subject to any disclaimer, the term of this patent is extended or adjusted under 35 U.S.C. 154(b) by 0 days.

(21) Appl. No.: 15/320,036

(22) PCT Filed: Jun. 24, 2015

(86) PCT No.: PCT/EP2015/064276
§ 371 (c)(1),
(2) Date: Dec. 19, 2016

(87) PCT Pub. No.: WO2015/197705
PCT Pub. Date: Dec. 30, 2015

(65) Prior Publication Data

US 2017/0145797 A1 May 25, 2017

(30) Foreign Application Priority Data

Jun. 25, 2014 (EP) ..... 14173873

(51) Int. Cl.
*E21B 43/10* (2006.01)
*E21B 33/14* (2006.01)
(Continued)

(52) U.S. Cl.
CPC ..... *E21B 43/105* (2013.01); *E21B 23/01* (2013.01); *E21B 33/1204* (2013.01); *E21B 33/14* (2013.01)

(58) Field of Classification Search
CPC ..... E21B 43/105; E21B 29/10; E21B 43/103; E21B 43/106; E21B 33/10
See application file for complete search history.

(56) References Cited

U.S. PATENT DOCUMENTS 5,348,095 A 9/1994 Worrall et al.
5,366,012 A 11/1994 Lohbeck
(Continued)

FOREIGN PATENT DOCUMENTS

WO 9800626 1/1998
WO 9935368 7/1999
(Continued)

*Primary Examiner* — Zakiya W Bates

(57) ABSTRACT

In an expansion assembly (1), an expandable bottom plug (10) is arranged below a primary expander (6) for expanding a tubular element (2). The expandable bottom plug (10) includes an expandable tubular clad element with a sealing section for sealing the expanded clad element to a lower portion of the expanded tubular element (2), and an anchoring section for anchoring the expanded clad element to the lower portion of the expanded tubular element. A secondary expander (22) is provided for radially expanding the clad element in the lower portion of the expanded tubular element by axial movement of the secondary expander through the clad element.

20 Claims, 8 Drawing Sheets

(51) Int. Cl.
*E21B 23/01* (2006.01)
*E21B 33/12* (2006.01)

(56) References Cited

U.S. PATENT DOCUMENTS

| | | | |
|---|---|---|---|
| 5,667,011 | A | 9/1997 | Gill et al. |
| 5,901,789 | A | 5/1999 | Donnelly et al. |
| 5,960,895 | A | 10/1999 | Chevallier et al. |
| 5,984,568 | A | 11/1999 | Lohbeck |
| 6,012,522 | A | 1/2000 | Donnelly et al. |
| 6,070,671 | A | 6/2000 | Cumming et al. |
| 6,196,316 | B1 | 3/2001 | Bosma et al. |
| 6,253,846 | B1 | 7/2001 | Nazzal et al. |
| 6,253,850 | B1 | 7/2001 | Nazzal et al. |
| 6,273,634 | B1 | 8/2001 | Lohbeck |
| 6,315,040 | B1 | 11/2001 | Donnelly |
| 6,328,113 | B1 | 12/2001 | Cook |
| 6,371,203 | B2 | 4/2002 | Frank et al. |
| 6,419,025 | B1 | 7/2002 | Lohbeck et al. |
| 6,431,282 | B1 | 8/2002 | Bosma et al. |
| 6,454,493 | B1 | 9/2002 | Lohbeck |
| 6,460,615 | B1 | 10/2002 | Heijnen |
| 6,470,966 | B2 | 10/2002 | Cook et al. |
| 6,497,289 | B1 | 12/2002 | Cook et al. |
| 6,557,640 | B1 | 5/2003 | Cook et al. |
| 6,561,227 | B2 | 5/2003 | Cook et al. |
| 6,564,875 | B1 | 5/2003 | Bullock |
| 6,568,471 | B1 | 5/2003 | Cook et al. |
| 6,575,250 | B1 | 6/2003 | Wijsman |
| 6,604,763 | B1 | 8/2003 | Cook et al. |
| 6,607,046 | B1 | 8/2003 | Betts et al. |
| 6,631,759 | B2 | 10/2003 | Cook et al. |
| 6,631,769 | B2 | 10/2003 | Cook et al. |
| 6,634,431 | B2 | 10/2003 | Cook et al. |
| 6,640,903 | B1 | 11/2003 | Cook et al. |
| 6,684,947 | B2 | 2/2004 | Cook et al. |
| 6,685,238 | B1 | 2/2004 | Pouillard |
| 6,705,395 | B2 | 3/2004 | Cook et al. |
| 6,712,154 | B2 | 3/2004 | Cook et al. |
| 6,725,919 | B2 | 4/2004 | Cook et al. |
| 6,739,392 | B2 | 5/2004 | Cook et al. |
| 6,745,845 | B2 | 6/2004 | Cook et al. |
| 6,758,278 | B2 | 7/2004 | Cook et al. |
| 6,823,937 | B1 | 11/2004 | Cook et al. |
| 6,857,473 | B2 | 2/2005 | Cook et al. |
| 6,860,420 | B2 | 3/2005 | Filippov et al. |
| 6,892,819 | B2 | 5/2005 | Cook et al. |
| 6,907,652 | B1 | 6/2005 | Heijnen |
| 6,966,370 | B2 | 11/2005 | Cook et al. |
| 7,040,396 | B2 | 5/2006 | Cook et al. |
| 7,048,067 | B1 | 5/2006 | Cook et al. |
| 7,063,142 | B2 | 6/2006 | Cook et al. |
| 7,152,673 | B2 | 12/2006 | Lohbeck et al. |
| 7,240,728 | B2 | 7/2007 | Cook et al. |
| 7,357,188 | B1 | 4/2008 | Cook et al. |
| 7,360,604 | B2 | 4/2008 | Lohbeck et al. |
| 7,389,822 | B2 | 6/2008 | Lohbeck et al. |
| 7,475,723 | B2 | 1/2009 | Ring et al. |
| 7,556,092 | B2 | 7/2009 | Cook et al. |
| 7,730,965 | B2 | 6/2010 | Jordan et al. |
| 2005/0144777 | A1 | 7/2005 | Cook et al. |
| 2006/0065403 | A1 | 3/2006 | Watson et al. |
| 2009/0266560 | A1 | 10/2009 | Ring et al. |

FOREIGN PATENT DOCUMENTS

| | | | | |
|---|---|---|---|---|
| WO | 200104535 | | 1/2001 | |
| WO | WO 2008131771 | A2 * | 11/2008 | ..... E21B 29/10 |
| WO | 2015197702 | | 12/2015 | |
| WO | 2015197703 | | 12/2015 | |

* cited by examiner

ASSEMBLY AND METHOD FOR EXPANDING A TUBULAR ELEMENT

CROSS REFERENCE TO RELATED APPLICATIONS

The present application is a National Stage (§ 371) of International Application No. PCT/EP2015/064276, filed Jun. 24, 2015, which claims the benefit of European Application No. 14173873.2, filed Jun. 24, 2014.

FIELD

The present invention relates to an assembly and a method for expanding a tubular element in a borehole. The borehole may be for exploration or production of hydrocarbons from a reservoir in an earth formation.

BACKGROUND

Wellbores for the production of hydrocarbon fluid generally are provided with steel casings and/or liners to provide stability to the wellbore wall and to prevent undesired flow of fluid between the wellbore and the surrounding earth formation. In a conventional wellbore, the wellbore is drilled in sections whereby each section is drilled using a drill string that has to be lowered into the wellbore through a previously installed casing. In view thereof the wellbore and the subsequent casing sections decrease in diameter with depth. The production zone of the wellbore therefore has a relatively small diameter in comparison to the upper portion of the wellbore.

It has been proposed to drill a mono diameter wellbore whereby the casing or liner to be installed is radially expanded in the wellbore after lowering to the required depth. Subsequent wellbore sections therefore may be drilled at a diameter larger than in the conventional wellbore and, if each casing section is expanded to the same diameter as the previous section, the wellbore diameter may remain substantially constant with depth.

US 2006/0065403 A1 discloses an assembly for expanding a tubular member in a wellbore using an expanding cone that is pulled through the tubular member by a force multiplier suspended on drill string. The assembly is provided with a bottom packer below the expander cone. The bottom packer is set in a launcher section of the tubular member and seals the tubular member from the wellbore. A conventional packing setting mechanism is used to expand and set the packer in the launcher section. After expansion of the tubular member, the bottom packer is drilled out of the casing and the next portion of the wellbore is drilled to a next desired depth.

The conventional bottom packer of the known assembly is a massive device consisting of many components including a setting mechanism. Problems may therefore arise during drilling out the packer using a drill bit or milling tool. For example, there is an inherent risk that individual components of the packer come loose during drilling out and cause damage to the cutters of the drill bit or milling tool.

US patent application US2009/0266560 discloses a tubular expansion assembly provided with a bottom plug(118), which, as illustrated in FIGS. 3,4,6 and 9-12, is not radially expanded, but drilled out after expansion of the upper part of the tubular.

It is an object of the invention to provide an improved assembly for creating an expanded tubular element in a borehole extending into an earth formation wherein the bottom plug is also expanded.

SUMMARY

The invention provides an assembly for expanding a tubular element in a borehole, the assembly comprising:

a primary expander for radially expanding a tubular element by axial movement of the primary expander through the tubular element;

a bottom plug arranged below the primary expander, the bottom plug including a tubular clad element adapted to be radially expanded in a downhole end portion of the tubular element, the clad element comprising sealing means for sealing the clad element to the downhole end portion of the tubular element and anchoring means for anchoring the clad element to the downhole end portion of the tubular element; and a secondary expander for radially expanding the clad element in the downhole end portion of the tubular element by axial movement of the secondary expander through the clad element.

In another aspect of the invention there is provided a method of expanding a tubular element in a borehole, the method comprising the steps of:

a) providing an expandable tubular element adapted to be radially expanded in the borehole;

b) radially expanding the tubular element in the borehole by moving a primary expander in axial direction through the tubular element;

c) arranging a bottom plug downhole of the primary expander, the bottom plug including a tubular clad element adapted to be radially expanded in a downhole end portion of the tubular element, the clad element including sealing means for sealing the clad element to the downhole end portion of the tubular element and anchoring means for anchoring the clad element to the downhole end portion of the tubular element; and d) radially expanding the clad element in the downhole end portion of the tubular element by moving a secondary expander in axial direction through the clad element.

BRIEF DESCRIPTION OF THE DRAWINGS

The invention will be described hereinafter in more detail and by way of example, with reference to the accompanying schematic drawings in which.

In the description herein below and the figures, like reference numerals relate to like components.

DETAILED DESCRIPTION

Figure 1:
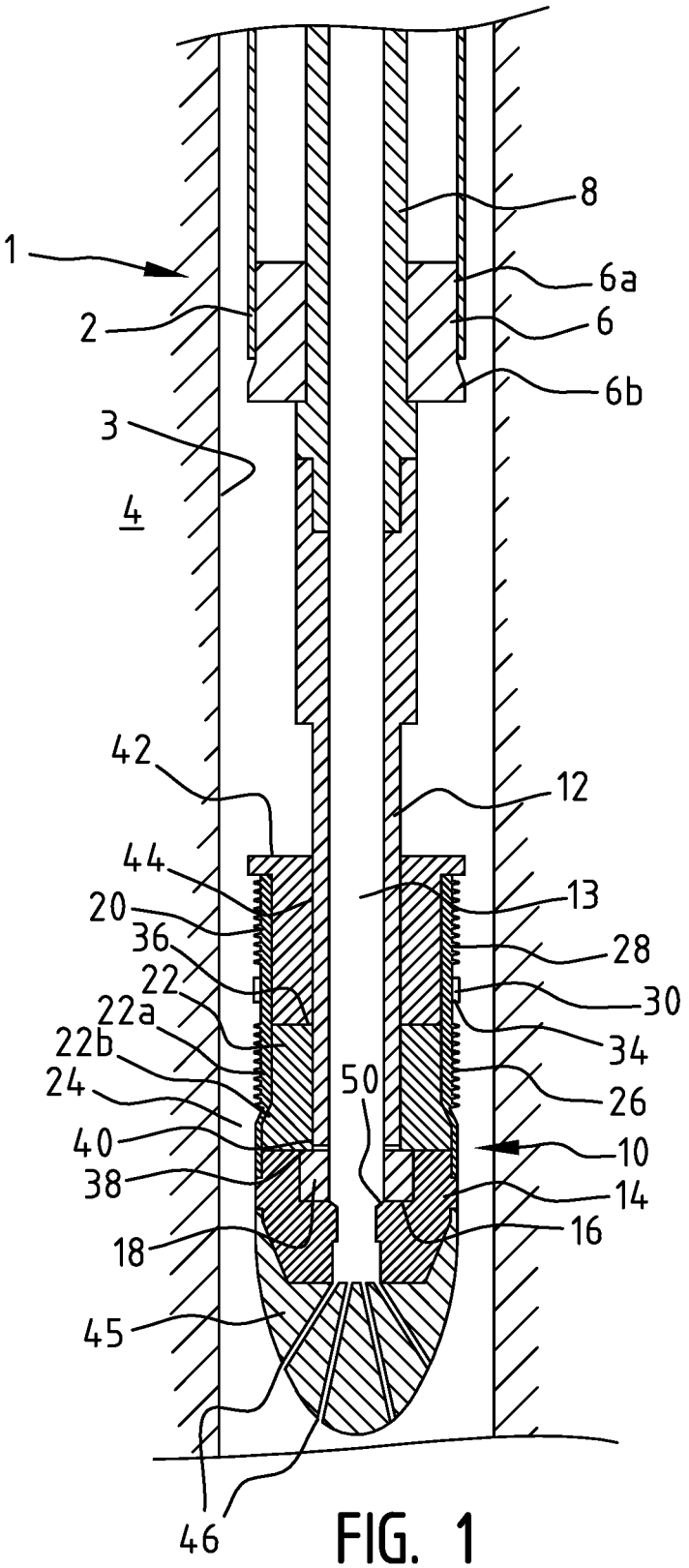
FIG. 1 schematically shows an embodiment of the assembly of the invention before expansion of the tubular element.

The presently proposed bottom plug contains relatively few components which can be drilled out easily after the clad element has been expanded and the secondary expander has been removed. Moreover, the bottom plug lacks setting components that might potentially come loose and damage the cutters during drilling out. The sealing means provide the desired sealing functionality, and the anchoring means provide the desired anchoring functionality of the bottom plug.

Suitably the bottom plug is provided with a fluid chamber, wherein the secondary expander is arranged to be moved through the clad element in axial direction thereof by fluid pressure in the fluid chamber. The fluid chamber may be in fluid communication with a pump at surface via a conduit extending into the borehole.

Further, the bottom plug may be provided with at least one outlet for pumping cement into the borehole, each outlet being in fluid communication with said conduit via a bore provided in the bottom plug, the bore having a seat for receiving a plug adapted to close the bore.

In one embodiment the conduit comprises a mandrel connecting the bottom plug to the primary expander, wherein the secondary expander is arranged to slide in axial direction along the mandrel during expansion of the clad element with the secondary expander. Also, the secondary expander may be adapted to be moved out of the clad element, wherein the mandrel is releasable from the bottom plug when the secondary expander is out of the clad element.

If the borehole needs to be reamed during running-in of the assembly, suitably the bottom plug is provided with a reamer for reaming the borehole by rotation of the bottom plug.

To keep the interior of the clad element free of debris during running-in, the clad element may be provided with a cap for preventing debris to enter the clad element, the cap being arranged to be removed from the clad element by axial movement of the secondary expander through the clad element.

In order to protect the sealing means and the anchoring means prior to expansion of the clad element, suitably a protective sleeve extends around the clad element, the protective sleeve being arranged to slide in axial direction along an unexpanded portion of the clad element by axial movement of the secondary expander through the clad element. The protective sleeve may be connected to the secondary expander by a connecting device having an axial part extending from the secondary expander through the unexpanded portion of the clad element. The connecting device has, for example, a radial part extending from the protective sleeve to the axial part of the connecting device. Further, the radial part may be arranged to prevent debris entering the clad element prior to radial expansion of the clad element with the secondary expander.

Suitably the anchoring means of the clad element comprises first anchoring means and second anchoring means axially spaced from the first anchoring means, wherein the sealing means is arranged between the first anchoring means and the second anchoring means.

The lower portion of the tubular element in which the clad element is to be radially expanded, may be an expanded portion of the tubular element.

Suitably the downhole end portion of the tubular element is an expanded portion of the tubular element, wherein the clad element is radially expanded in the downhole end portion of the tubular element before radially expanding a remaining upper portion of the tubular element.

In one embodiment, an amount of cement is pumped into the borehole via at least one outlet opening provided in the bottom plug prior to radially expanding said lower portion of the tubular element. The cement may be pumped, for example, via a bore provided in the bottom plug, the bore having a seat for receiving a closure device to close the bore. After pumping the amount of cement, the closure device is pumped to the seat of the bore so as to close the bore.

The secondary expander may be arranged to be moved in axial direction through the clad element by fluid pressure in a fluid chamber provided in the bottom plug. After closing the bore by the closure device, a body of fluid is pumped into the fluid chamber of the bottom plug so as to move the secondary expander in axial direction through the clad element thereby radially expanding the clad element. Suitably the secondary expander thereby slides along the mandrel which interconnects the bottom plug and the primary expander, and wherein the secondary expander is pumped out of the clad element and the mandrel is released from the bottom plug when the secondary expander is out of the clad element.

Suitably the steps of radially expanding the tubular element and radially expanding the clad element are performed simultaneously whereby the axial velocity of the primary expander and the axial velocity of the secondary expander are dependent on each other to maintain a volume of fluid in the tubular element between the primary expander and the secondary expander substantially constant.

FIG. 1 shows an assembly 1 for expanding a tubular element 2 in a wellbore 3 extending into an earth formation 4. The assembly 1 comprises a primary expander 6 connected to an expansion mandrel 8 suspended in the wellbore 3 on a drill string (not shown) that normally may be used for drilling of the wellbore. The primary expander 6 has a cylindrical upper portion 6*a* of diameter substantially equal to the inner diameter of the unexpanded tubular element 2 and a conical lower portion 6*b* of diametrical size adapted to expand the tubular element 2 to the desired diameter to form a liner in the wellbore 3. The tubular element 2 is suspended on the primary expander 6 whereby the cylindrical portion 6*a* thereof extends into the lower end of the tubular element 2.

The assembly 1 furthermore comprises a bottom plug 10 arranged below the primary expander 6. The bottom plug may be connected to a plug mandrel 12 in a releasable manner, the plug mandrel being fixedly connected to the downhole end of the expansion mandrel 8. The plug mandrel 12, the expansion mandrel 8 and the drill string have a common fluid channel 13 for fluid pumped from surface to the bottom plug 10. The bottom plug 10 comprises a flange 14 having a recess 16 into which a downhole end part 18 of the plug mandrel 12 fits. The recess 16 and downhole end part 18 have complementary hexagonal shapes so as to allow torque to be transmitted between the plug mandrel 12 and the bottom plug 10, however any other suitable shape may be selected to allow torque to be transmitted. A radially expandable tubular clad element 20 is fixedly connected to the flange 14 and extends coaxially around the plug mandrel 12. A secondary expander 22 is arranged inside the clad element 20, the secondary expander having a cylindrical upper portion 22*a* of diameter substantially equal to the inner diameter of the unexpanded clad element 20 and a conical lower portion 22*b* of maximum diameter adapted to expand the clad element 20 against the inner surface of tubular element 2 after radial expansion thereof. The clad element 20 has a launcher section in the form of thin walled lower section 24 with an oversized inner diameter to accommodate the conical lower portion 22*b* of the secondary expander. The clad element further includes a lower anchoring section 26, an upper anchoring section 28 axially spaced from the lower anchoring section, and a sealing section 30 located between the lower and upper anchoring sections 26, 28. Each anchoring section 26, 28 is at the outer surface provided with a coating of friction material, for example a coating including carbide particles embedded in a substrate that is metallically bonded to the outer surface by means of laser welding. The sealing section 30 is at the outer surface provided with annular seals 34.

The plug mandrel 12 extends through a central bore 36 of the secondary expander 22 in a manner allowing the secondary expander 22 to slide in axial direction along the plug mandrel 12. The plug mandrel 12 is provided with flow ports 38 fluidly connecting the fluid channel 13 with a fluid chamber 40 formed between the large diameter end of the secondary expander 22 and the flange 14. Initially the axial size of the fluid chamber 40 is very small but increases during expansion of the clad element 20 as will be explained hereinafter. The upper end of the clad element 20 is covered by a removable debris cap 42 having a central bore 44 through which the plug mandrel 12 extends in a manner allowing the debris cap 42 to slide in axial direction along the plug mandrel 12. The debris cap 42 serves to prevent debris entering the clad element 20 prior to radial expansion thereof. Further, the bottom plug 10 is provided with a reamer 45 having outlet openings 46 in fluid communication with the fluid channel 13 via a bore 48 in the flange 14, the bore 48 having a seat 50 for receiving a trailing plug 52 to close the bore (FIG. 2).

Figure 2:
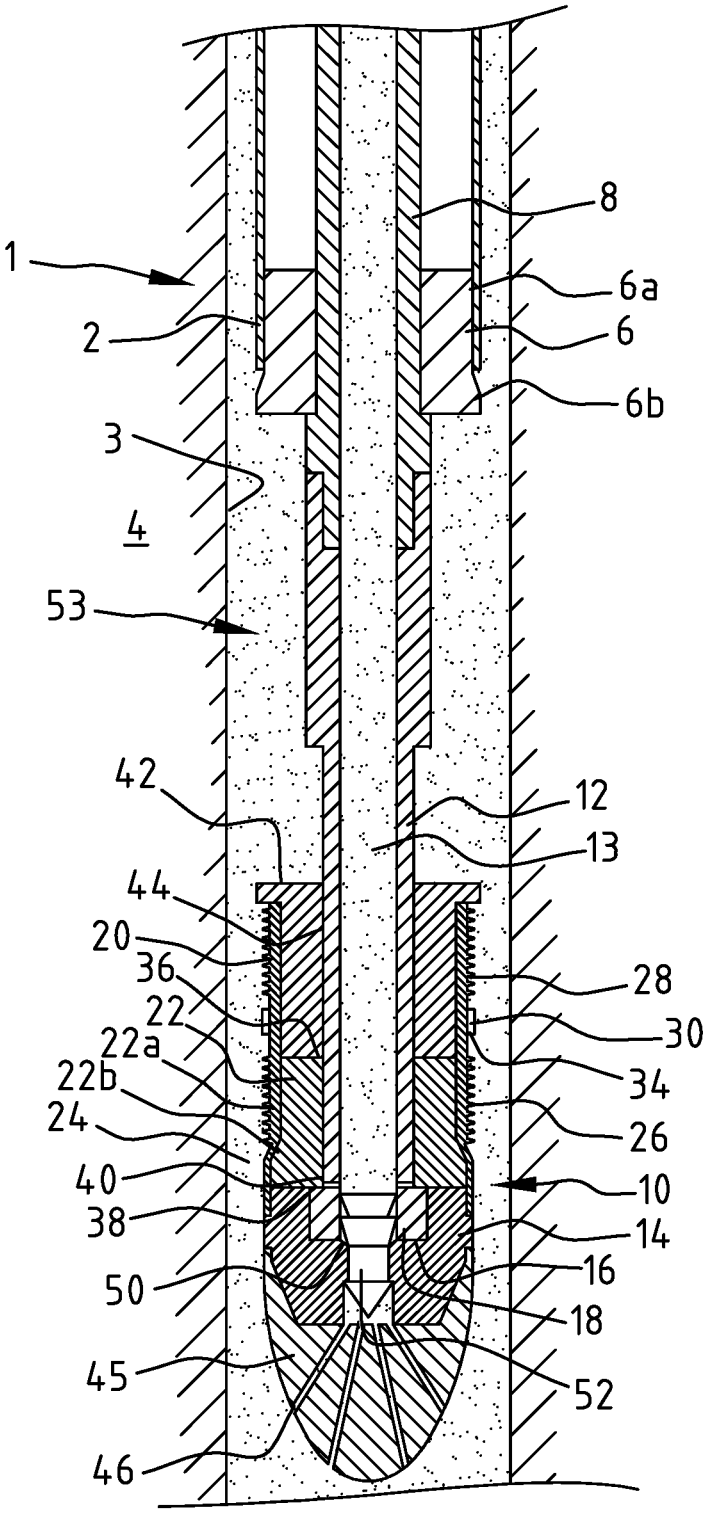
FIG. 2 schematically shows the assembly after pumping cement into the wellbore.

FIG. 2 shows the assembly 1 whereby a fluidic cement column 53 surrounds the tubular element 2 and the assembly 1. The trailing plug 52 is received on the seat of the bore 48 and thereby closes the bore 48.

Figure 3:
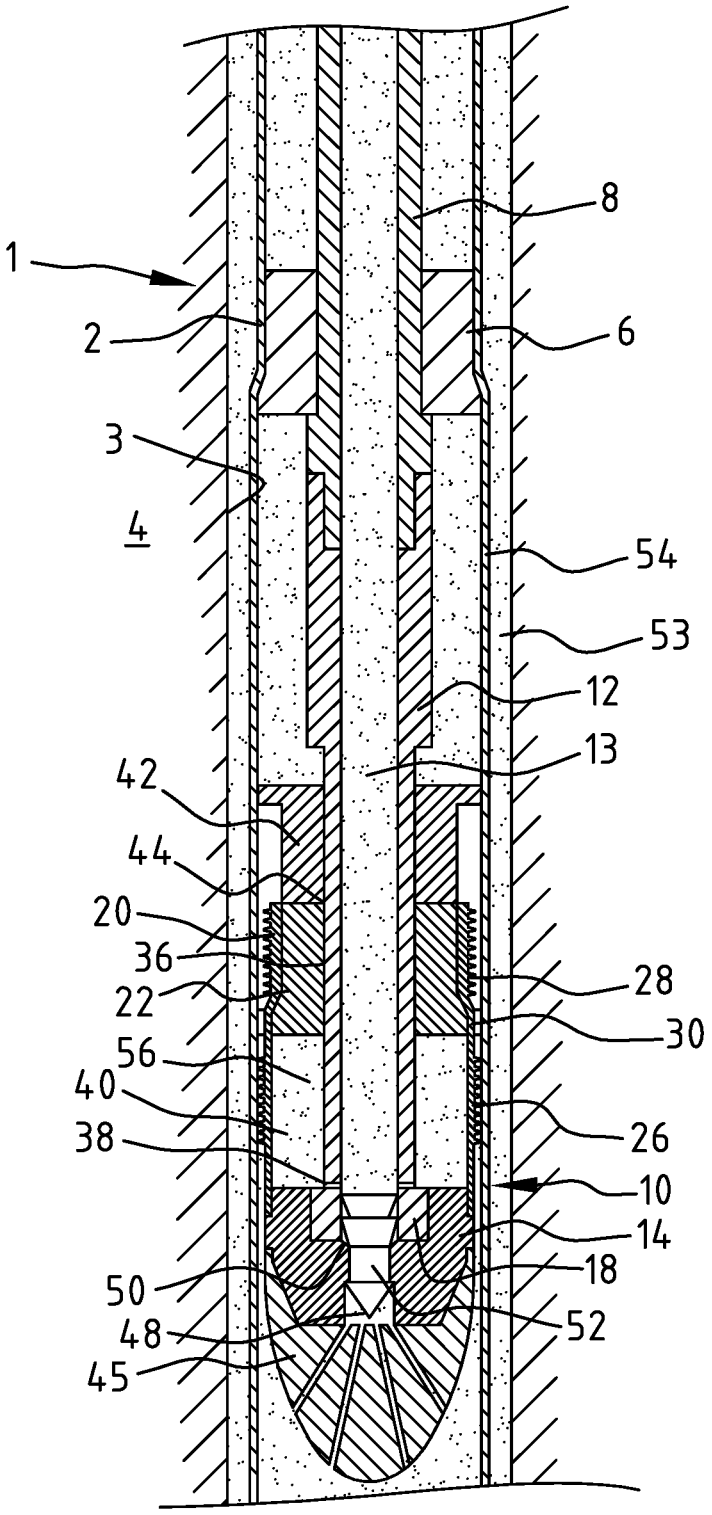
FIG. 3 schematically shows the assembly during expansion of the clad element.

FIG. 3 shows the assembly 1 after a downhole end portion 54 of the tubular element 2 has been expanded by the primary expander 6, whereby the bottom plug 10 is positioned in the expanded downhole end portion 54 and the clad element 20 is partly expanded against the inner surface of the expanded downhole end portion 54. A volume of hydraulic fluid 56, such as spacer fluid or drilling fluid, has been pumped into the fluid chamber 40 via the drill string, the expansion mandrel 8 and the plug mandrel 12.

Figure 4:
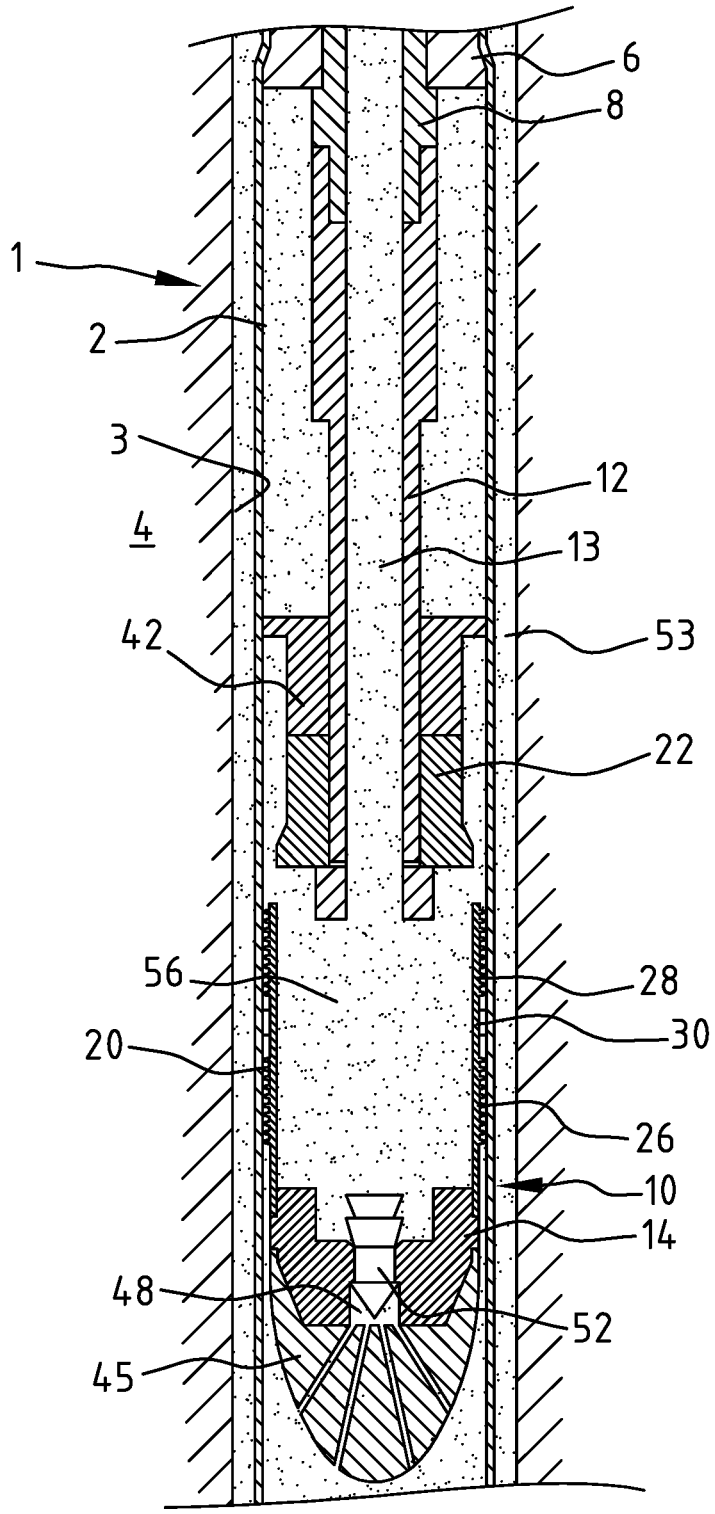
FIG. 4 schematically shows the assembly after the bottom plug has been set.

FIG. 4 shows the assembly 1 after the clad element 20 has been fully expanded against the inner surface of the expanded lower portion 54 of the tubular element 2, whereby the plug mandrel 12 is released from the flange 14. The secondary expander 22 and the debris cap 42 are still positioned at the plug mandrel.

Figure 5:
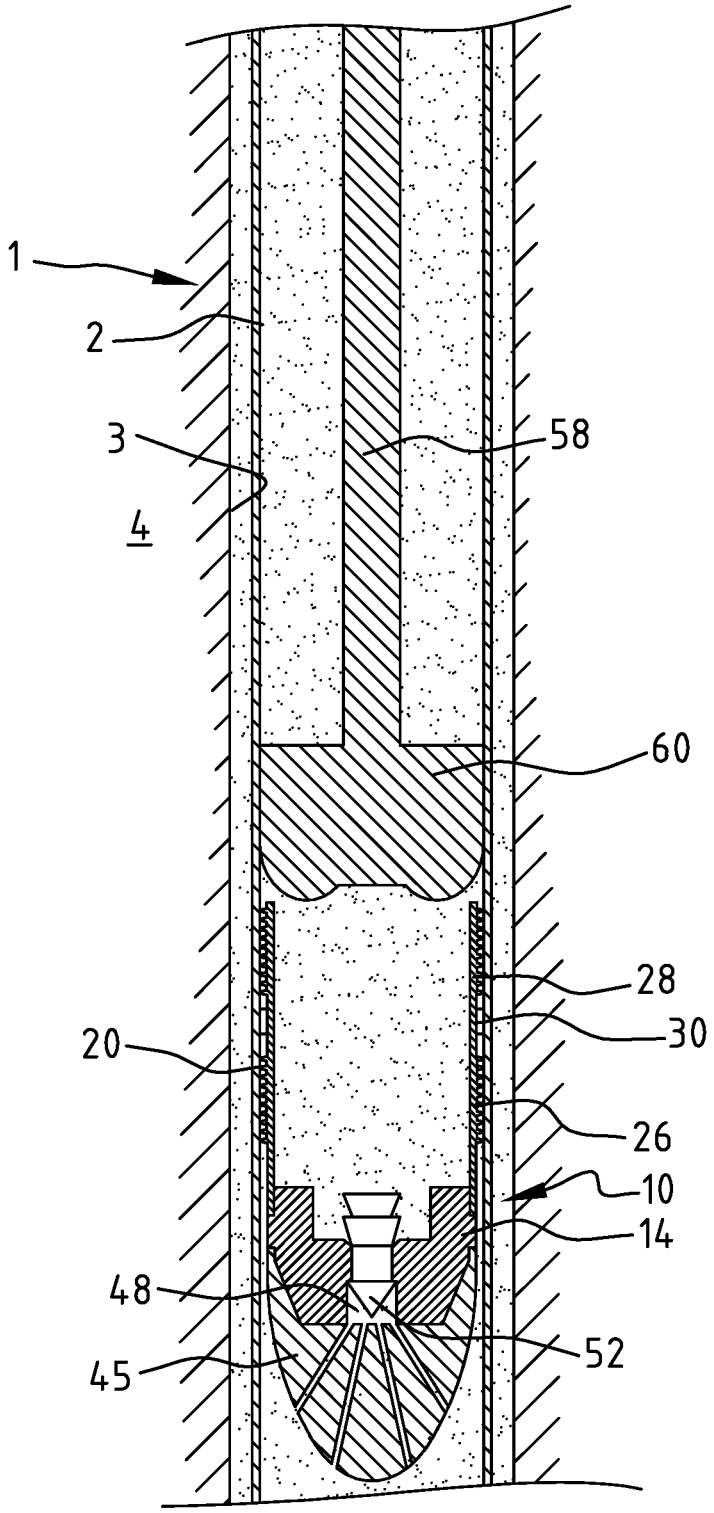
FIG. 5 schematically shows the assembly during drilling-out of the bottom plug.

FIG. 5 shows the assembly 1 after tubular element 2 has been fully expanded, and the expansion mandrel 8 and the plug mandrel 12 together with the secondary expander 22 and the debris cap 42 have been removed from the wellbore 3. A drill string 58 with a polycrystalline diamond compact (PDC) bit 60 is lowered into the expanded tubular element 2 to drill out the remainder of the bottom plug 10. Instead of the PDC bit 60, a dedicated milling tool may be applied to drill out the remainder of the bottom plug.

Figure 6:
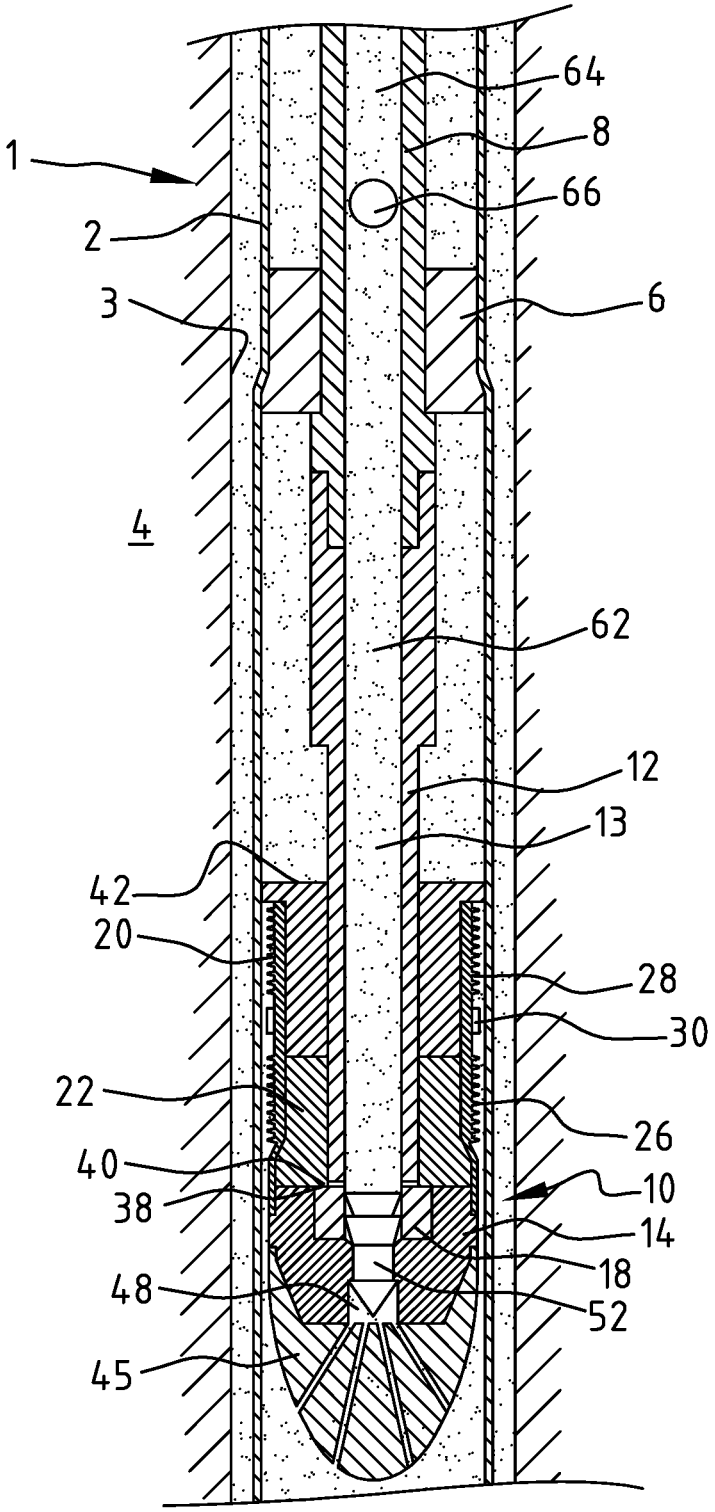
FIG. 6 schematically shows the assembly during an alternative method of operation.

In FIG. 6 is shown the assembly 1 whereby a volume of fluidic cement 62 and a volume of trailing spacer fluid 64 is present in the fluid channel 13, the volumes 62, 64 being mutually separated by a trailing foam ball 66.

Figure 7:
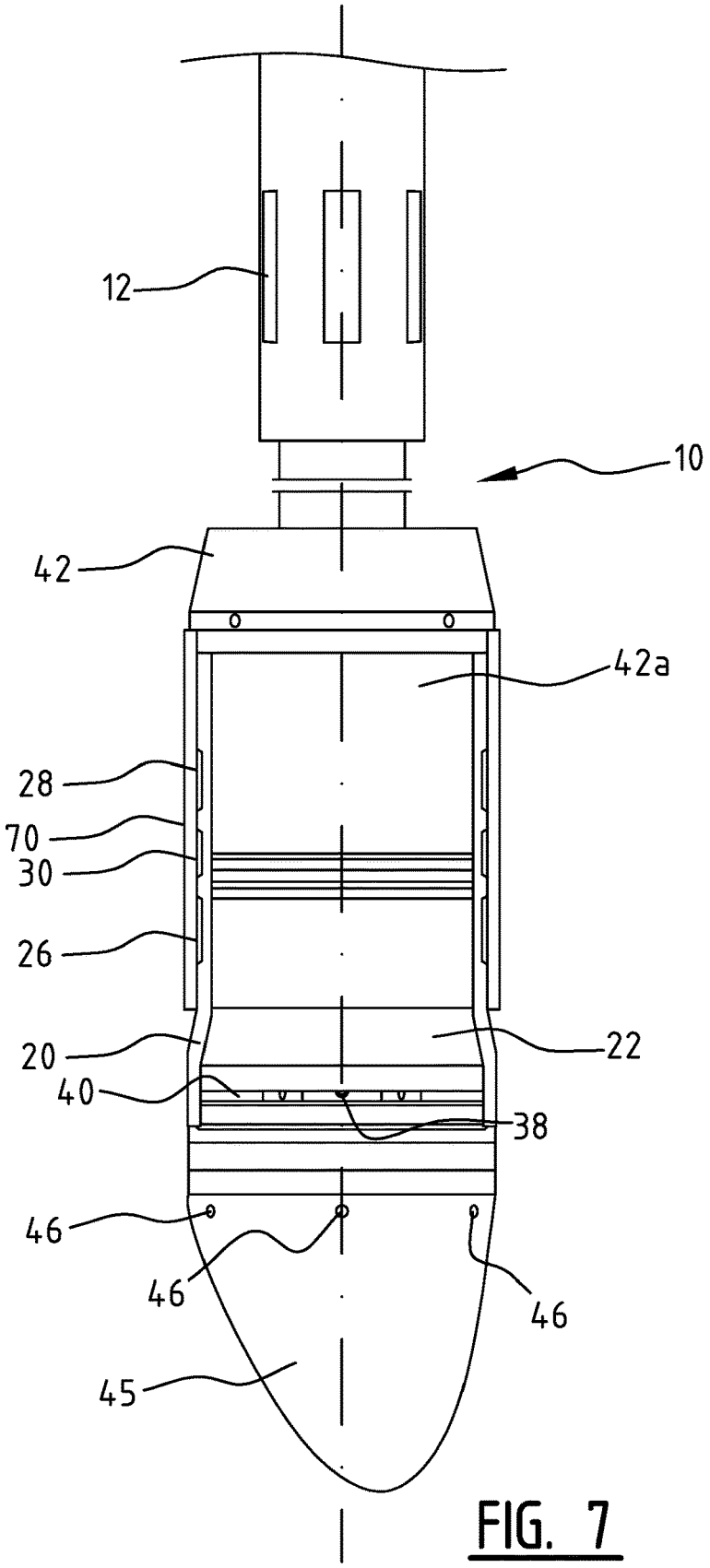
FIG. 7 schematically shows the assembly provided with a protective sleeve around the clad element.

Referring further to FIG. 7 there is shown an embodiment wherein the assembly 1 is provided with a protective sleeve 70 extending around the sealing section 30 and the anchoring sections 26, 28 of the clad element 20. The sleeve 70 is connected to the debris cap 42 which has a cylindrical part 42*a* that extends into the clad element 20 and abuts against the secondary expander 22.

Figure 8:
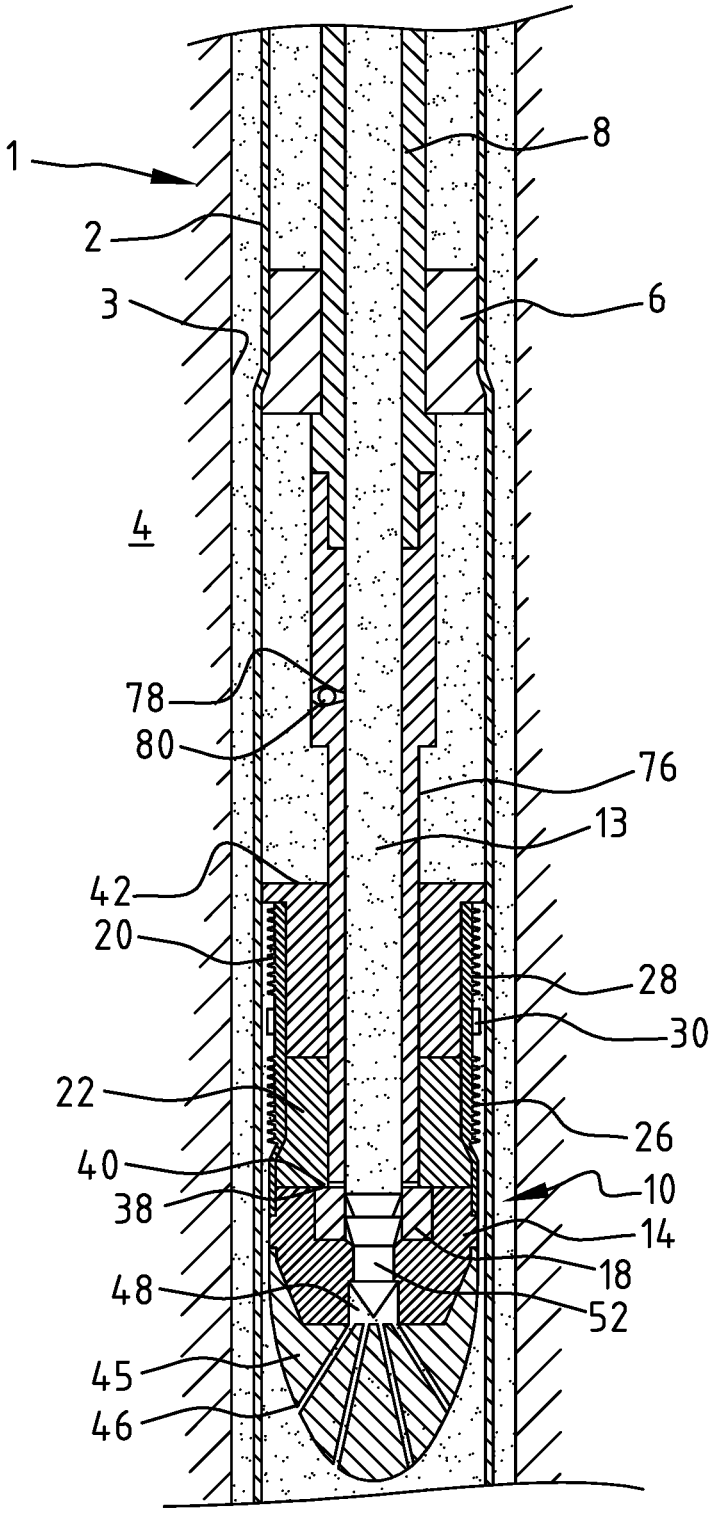
FIG. 8 schematically shows the assembly provided with an alternative plug mandrel.

FIG. 8 shows an embodiment wherein the assembly 1 includes a plug mandrel 76 that is provided with a flow port 78 fluidly connecting the fluid channel 13 with the annular space between the plug mandrel 76 and the expanded tubular element 2. The flow port 78 is temporarily closed by a back pressure valve 80 that opens at a selected overpressure in the fluid channel 13 relative to the annular space. Instead of the back pressure valve, the flow port 78 may be temporarily closed by a burst disc (not shown) that opens at the selected overpressure.

Normal operation of the assembly 1 is as follows. The assembly 1 is lowered into the wellbore 3 on the drill string whereby optionally the assembly 1 may be rotated to ream sections of the wellbore 3 by reamer 45, and drilling fluid may be pumped into the wellbore. Once the assembly 1 has reached target depth of the wellbore, the tubular element 2 is at its upper end anchored in the wellbore 3. Subsequently a volume of leading spacer fluid (not shown) is pumped into the wellbore via the fluid channel 13 to clean the fluid channel from drilling fluid, followed by the fluidic cement column 53 and a volume of trailing spacer fluid 84. Instead of trailing spacer fluid, drilling fluid may be used. The leading spacer fluid and the fluidic cement 53 may be separated by a foam ball that crushes upon arriving in the bore 48 of the bottom plug 10 and is released through the outlet openings 46. The fluidic cement 53 and the trailing spacer fluid 84 are separated by the trailing plug 52 that seats on the seat 50 upon arriving in the bore 48. Thus, at this stage the volume of trailing spacer is present in the fluid channel 13, and the cement column surrounds the bottom plug 10 and the tubular element 2. The trailing plug 52 closes the bore 48 and thereby seals the fluid channel 13 from the annular space around the assembly 1 in the wellbore 3. The primary expander 6 abuts against the lower end of the tubular element 2 therefore fluidic cement cannot enter the tubular element 2 (FIG. 2).

After the trailing plug 52 has seated on the seat 50, the primary expander 6 is pulled into the tubular element 2 by pulling the drill string whereby the lower portion 54 of the tubular element 2 is expanded. Expansion is proceeded until the bottom 10 plug is fully inside the expanded lower portion 54. While maintaining the drill string under tension, fluid pressure is applied in the fluid channel 13 so that the trailing spacer fluid 84 flows via the flow ports 38 of the plug mandrel 12 into the fluid chamber 40. The secondary expander 22 thereby slides along the plug mandrel 12 away from the flange 14 and gradually expands the clad element 20 against the expanded lower portion 54 of the tubular element 2. The lower anchoring section 26 first engages the expanded lower portion 54, followed by the sealing section 30 and subsequently the upper anchoring section 28. Upon the sealing section 30 engaging the expanded lower portion 54, the tubular element 2 is simultaneously further expanded with the primary expander 6 to maintain volume balance in the expanded section of the tubular element 2 between the bottom plug 10 and the primary expander 6 (FIG. 3).

Once the clad element 20 is fully expanded against the expanded tubular element 2, the secondary expander moves out of the clad element and thereby pushes the debris cap 42 off the clad element 20. The interior of the expanded clad element 20 is then filled with trailing spacer fluid or drilling fluid that may be contaminated with cement. In a subsequent step the remainder of the tubular element 2 is expanded with the primary expander 6 whereby the secondary expander 22 and the debris cap 42 are carried out of the wellbore 3 on the plug mandrel 12 (FIG. 4). After the bottom plug 10 has been set in the expanded lower portion 54 of the tubular element, fluid pressure can be applied below the primary expander 6 via the fluid channel 13 to provide additional upward force to the primary expander 6 (hydraulic assist). Alternatively, the entire expansion force required to expand the tubular element 2 may be provided by such fluid pressure, that is without applying tensile force to the drill string.

The design functionality of the upper and lower anchoring sections 26, 28 and the sealing section 30 is as follows. When the fluid pressure in the interior space of the fully expanded clad element 20 is higher than the fluid pressure below the bottom plug 10, the clad element is subjected to balloon deformation whereby the lower anchoring section 26 becomes firmly pressed against the expanded tubular element 2. Conversely, when the fluid pressure below the bottom plug 10 is higher than the fluid pressure in the interior space of the fully expanded clad element 20, for example due to swab pressure below the primary expander 6 during expansion of the tubular element 2, the clad element is subjected to balloon deformation whereby the upper anchoring section 28 becomes firmly pressed against the expanded tubular element 2.

After the cement has fully cured, the bottom plug 10 is drilled out with the PDC bit 60 or milling tool on drill string 58 whereby the bottom plug is supported by the cement 53 surrounding it (FIG. 5).

In a variation of the method of applying the assembly 1, the cement 53 is pumped into the wellbore after the lower portion 54 of the tubular element has been expanded and the bottom plug 10 has been pulled into the expanded lower portion 54. This approach may be followed if there is a risk that the secondary expander 22 is activated before the bottom plug 1 is inside the lower portion 54 of the tubular element, e.g. due to pressure waves in the fluid channel 13 propagating into the fluid chamber 40 during pumping of cement into the wellbore. However since in the alternative method there is reduced annular space between the expanded lower portion 54 of the tubular element and the wellbore wall, the pressure drop required to pump the cement at a certain rate through the annular space increases, which may lead to an increased risk of formation fracturing in critical pressure regimes.

Stabilization of the PDC bit or milling tool 60 during drilling-out of the bottom plug 10 may be optimized as follows (FIG. 6). In the methods described above the clad element 20 is hydraulically expanded with the trailing spacer fluid 84 as a pressure medium. Consequently after completion of the expansion process the interior of the clad element 20 is filled with trailing spacer fluid that may be contaminated with some cement. In order to optimize stabilization of the PDC bit or milling tool 60 during drilling-out of the bottom plug 10, an additional volume of cement 86 is pumped behind the trailing plug 52 which is at least sufficient to expand the clad element 20. A trailing foam ball 88 is pumped behind the volume of cement 86, optionally followed by a volume of trailing spacer fluid (not shown). After the trailing plug 52 has seated in the bore 48, the installation process is continued as described above whereby the pressure medium used for the expansion of the clad element 20 is cement rather than trailing spacer fluid or drilling fluid. During expansion of the tubular element 2 the trailing foam ball 88 will be pumped out of the plug mandrel 12 into the wellbore. Thus, after curing of the cement 86 the bottom plug 10 will be surrounded by cured cement with optionally excess cured cement above the clad element 20 to mitigate the risk of damage to the PDC bit or milling tool 60 upon tagging the bottom plug 10 and to provide optimum conditions for drilling-out of the bottom plug 10.

In addition to the above, the risk of damage to the cutters of the PDC bit or milling tool 60 when tagging the top of the clad element 20 can be further mitigated by connecting a short pipe section (not shown) of a soft metal, for example copper, to the top of the clad element 20. The pipe section is subjected to plastic deformation due to loading by the PDC cutters thereby limiting the peak contact load and thus the risk of impact damage to the PDC cutters.

Normal operation of the assembly 1 provided with the protective sleeve 70 around the clad element 20 is substantially similar to normal operation of the assembly 1 described above. In addition, the protective sleeve 70 protects the sealing section 30 and the anchoring sections 26, 28 during lowering of the assembly 1 into the wellbore 3. The sleeve 70 is axially fixed to the secondary expander 22 by virtue of the connection thereto via the debris cap 42 and the spacer rods 72. Therefore, during expansion of the clad element 20, the sleeve 70 moves along the unexpanded portion of the clad element 20 at the same axial speed as the secondary expander 22. In this manner optimum protection is provided to the sealing and anchoring sections 26, 28, 30 which only become exposed just before the secondary expander expands these sections.

Normal operation of the assembly 1 provided with the alternative plug mandrel 76 is substantially similar to normal operation of the assembly 1 described above except regarding the following. During expansion of the clad element 20 the seals 34 engage the wall of the expanded tubular portion 54. This creates a trapped volume between the seals 34 and the primary expander 6. In the methods described above, this volume balance is maintained during continued expansion of the clad element 20 by adapting the velocity at which the secondary expander 22 slides along the plug mandrel 12 to the axial velocity of the primary expander 6 in the tubular element 2. During use of the embodiment with the alternative plug mandrel 76, the flow port 78 is initially closed by back pressure valve 80 to enable drilling fluid circulation during running-in of the assembly 1 into the hole and hydraulic expansion of the clad element 20. Once the seals 34 of the clad element 20 engage the wall of the expanded tubular element 2, the fluid pressure in the space constrained by the tubular element 2, the clad element 20, the secondary expander 22 and the primary expander 6 decreases upon further expansion of the tubular element 2. This pressure reduction causes the back pressure valve 80 or burst disc to open the flow port 78 at the selected overpressure in the fluid channel 13 so as to maintain volume balance during the remainder of the expansion process. This embodiment has the advantages that the hydraulic pressure to set the clad element 20 is reduced, that the design is robust and that the volume balance is maintained automatically.

For example, if the required fluid pressure in the fluid chamber for expanding the clad element 20 is 200 bar, and the selected overpressure of the back pressure valve 82 or burst disc is set at 250 bar, the maximum collapse pressure acting on the expanded tubular element 2 as a result of setting the clad plug will not exceed 50 bar. In an alternative arrangement, opening of the flow port 78 may be triggered by a selected minimum axial displacement of the secondary expander 22 in the clad element 20.

In a modified version of the assembly 1, the bottom plug 10 is additionally provided with an activation sleeve (not shown) positioned in the fluid channel 13 so as to temporarily close-off the flow ports 38, whereby the activation sleeve is connected to the plug mandrel 12 by shear pins. The activation sleeve is adapted to slide in downward direction when the shear pins are broken whereby the flow ports 38 become in fluid communication with the fluid channel 13. Upon arrival of the trailing plug 52 in the bottom plug 10, the trailing plug 52 is caught in the activation sleeve and thereby pushes the activation sleeve in downward direction whereby the shear pins are sheared-off and the flow ports 38 are opened. In this manner it is prevented that the secondary expander 22 is inadvertently activated by fluid pressure peaks in the fluid channel 13 before the trailing plug 52 has arrived in the bottom plug.

The present invention is not limited to the above-described embodiments thereof, wherein various modifications are conceivable within the scope of the appended claims. For instance, features of respective embodiments may be combined.

The invention claimed is:

1. An assembly for expanding a tubular element in a borehole, the assembly comprising:

a primary expander for radially expanding the tubular element by axial movement of the primary expander through the tubular element, said primary expander comprising a portion of diametrical size that exceeds an inner diameter of the tubular element;

a bottom plug arranged below the primary expander;

the bottom plug includes a tubular clad element adapted to be radially expanded in a downhole end portion of the tubular element;

the clad element comprises sealing means for sealing the expanded clad element to the downhole end portion of the tubular element and anchoring means for anchoring the clad element to a downhole end portion of the tubular element; and the assembly further comprises a secondary expander for radially expanding the clad element in the downhole end portion of the tubular element by axial movement of the secondary expander through the clad element.

2. The assembly of claim 1, the bottom plug being provided with a fluid chamber for moving the secondary expander through the clad element in axial direction thereof by fluid pressure in the fluid chamber.

3. The assembly of claim 2, wherein the fluid chamber is in fluid communication with a pump at surface via a conduit extending into the borehole.

4. The assembly of claim 3, wherein the bottom plug is provided with at least one outlet for pumping cement into the borehole, each outlet being in fluid communication with said conduit via a bore provided in the bottom plug, the bore having a seat for receiving a plug adapted to close the bore.

5. The assembly of claim 3, comprising a mandrel connectable to the conduit, for connecting the bottom plug to the primary expander, wherein the secondary expander is arranged to slide in axial direction along the mandrel during expansion of the clad element.

6. The assembly of claim 5, wherein the secondary expander is adapted to be moved out of the clad element, and wherein the mandrel is releasable from the bottom plug to be released when the secondary expander is moved out of the clad element.

7. The assembly of claim 1, the bottom plug comprising a reamer for reaming the borehole by rotation of the bottom plug.

8. The assembly of claim 1, the clad element comprising a cap for preventing debris to enter the clad element, the cap being removable from the clad element by axial movement of the secondary expander through the clad element.

9. The assembly of claim 1, further comprising a protective sleeve extending around the clad element, the protective sleeve being arranged to slide in axial direction along an unexpanded portion of the clad element by axial movement of the secondary expander through the clad element and being connected to the secondary expander by a connecting device having an axial part extending from the secondary expander through the unexpanded portion of the clad element and wherein the connecting device has a radial part extending from the protective sleeve to the axial part of the connecting device.

10. The assembly of claim 1, the anchoring means of the clad element comprising first anchoring means and second anchoring means axially spaced from the first anchoring means, wherein the sealing means are arranged between the first anchoring means and the second anchoring means and wherein the downhole end portion of the tubular element is an expanded portion of the tubular element.

11. The assembly of claim 1, wherein in anchored condition, whereby the anchor means engages with the downhole end portion of the tubular element, the bottom plug is fully inside the downhole end portion of the tubular element.

12. A method of expanding a tubular element in a borehole, the method comprising the steps of:

a) providing an expandable tubular element adapted to be radially expanded in the borehole;

b) radially expanding the tubular element in the borehole by moving a primary expander in axial direction through the tubular element, which primary expander comprising a portion of diametrical size that exceeds an inner diameter of the tubular element prior to expanding;

c) arranging a bottom plug downhole of the primary expander, the bottom plug including a tubular clad element adapted to be radially expanded in a downhole end portion of the tubular element, the clad element including sealing means for sealing the clad element to the downhole end portion of the tubular element and anchoring means for anchoring the clad element to the downhole end portion of the tubular element; and d) radially expanding the clad element in the downhole end portion of the tubular element by moving a secondary expander in axial direction through the clad element.

13. The method of claim 12, wherein the downhole end portion of the tubular element is an expanded portion of the tubular element, and wherein the clad element is radially expanded in the downhole end portion of the tubular element before radially expanding a remaining upper portion of the tubular element.

14. The method of claim 13, further comprising the step of pumping an amount of cement slurry into the borehole via at least one outlet opening provided in the bottom plug before radially expanding said downhole end portion of the tubular element and wherein said amount of cement is pumped via a bore provided in the bottom plug, the bore having a seat for receiving a closure device to close the bore, the method comprising the steps of:

pumping the closure device to the seat of the bore so as to close the bore after pumping said amount of cement; and pumping fluid into a fluid chamber of the bottom plug to move the secondary expander in axial direction through the clad element by fluid pressure in the fluid chamber, thereby radially expanding the clad element after closing the bore.

15. The method of claim 12, wherein the secondary expander slides along a mandrel during radial expansion of the clad element, the mandrel interconnecting the bottom plug and the primary expander, and wherein the method further comprises pumping the secondary expander out of the clad element and releasing the mandrel from the bottom plug when the secondary expander is out of the clad element.

16. The method of claim 12, wherein the steps of radially expanding the tubular element and radially expanding the clad element are performed simultaneously, and wherein the axial velocity of the primary expander and the axial velocity of the secondary expander are dependent on each other to maintain a volume of fluid between the primary expander and the secondary expander substantially constant.

17. The method of claim 12, wherein prior to arranging the bottom plug in the downhole end portion of the tubular element the downhole end portion is expanded.

18. The method of claim 12, wherein anchoring means comprises first anchoring means and second anchoring means axially spaced from the first anchoring means, wherein the sealing means are arranged between the first anchoring means and the second anchoring means and wherein the downhole end portion of the tubular element is an expanded portion of the tubular element.

19. The method of claim 18, wherein during radially expanding the clad element in the downhole end portion of the tubular element by moving the secondary expander in axial direction through the clad element, the first anchoring means first engages with the expanded downhole end portion, followed by the sealing means and subsequently the second anchoring means.

20. The method of claim 12, wherein the bottom plug is fully inside the downhole end portion of the tubular element before radially expanding the clad element in the downhole end portion of the tubular element.

* * * * *